United States Patent [19]

Nevin et al.

[11] Patent Number: 4,981,416

[45] Date of Patent: Jan. 1, 1991

[54] ENHANCED AIR-FLOW BLOWER WHEEL

[75] Inventors: Ira Nevin, Eastchester; Narendra Nath, Copiague, both of N.Y.

[73] Assignee: Bakers Pride Oven Co. Inc., New Rochelle, N.Y.

[21] Appl. No.: 450,571

[22] Filed: Dec. 14, 1989

Related U.S. Application Data

[62] Division of Ser. No. 304,770, Jan. 31, 1989, Pat. No. 4,928,663.

[51] Int. Cl.[5] ..... B63H 7/02; B64C 11/00

[52] U.S. Cl. ..... 416/178; 416/187; 415/206

[58] Field of Search ..... 415/203; 416/178, 179, 416/181, 182, 184, 186 R, 187, 223 R, 223 B, 227 R, 227 A, 231 R, 231 B, DIG. 3, 120, 124

[56] References Cited

U.S. PATENT DOCUMENTS 1,916,626 7/1933 McKean et al. ..... 415/203
2,266,180 12/1941 Emerick ..... 416/186 R
2,960,316 11/1960 McKellar ..... 415/203
3,991,703 11/1976 Faust et al. ..... 416/181
4,428,717 1/1984 Catterfeld ..... 416/186

*Primary Examiner*—Edward K. Look
*Assistant Examiner*—Hoang Nguyen
*Attorney, Agent, or Firm*—Brumbaugh, Graves, Donohue & Raymond

[57] ABSTRACT

An enhanced, air-flow convection oven is disclosed, comprising an oven chamber liner circumscribed by a thermally insulated outer oven shell with a heat source in a combustion chamber between the shell and the liner. Hot air flows from the combustion chamber and into a uniquely constructed blower wheel assembly. The blower assembly has a concave central plate configuration which creates a negative pressure behind the blower wheel assembly, inducing a flow of hot air from the back of the blower wheel assembly into the blower wheel assembly as the wheel rotates. This hot air is mixed with air from within the chamber to produce uniform heating throughout the chamber.

12 Claims, 4 Drawing Sheets

ENHANCED AIR-FLOW BLOWER WHEEL

This application is a division of application Ser. No. 304,770, filed on Jan. 31, 1989 now U.S. Pat. No. 4,928,663.

BACKGROUND OF THE INVENTION

1. Field of the Invention

This invention relates to the field of forced convection ovens and, more particularly, to an improved heat balanced air-flow circulating system for use therein.

2. Description Of The Prior Art

Convection is the movement of currents in a fluid or gas of uneven temperatures due to the variation of its density and the resultant action of gravity and the circulation of heat thus effected. A familiar example is the free or forced movement of warm air throughout a room to provide heat. Recirculation by forced convection has been applied to ovens for some time.

Recirculating forced convection ovens generally embody a heat source, such as a gas burner, positioned in a compartment formed between an insulated outer oven shell and an oven chamber liner. A blower, in a flow path between the heat source and the outlet opening of the oven chamber liner, propels by forced convection, the heated air to the oven chamber and through an exhaust flue.

Rapid movement of heated air through the oven chamber is desirable to increase the efficiency of convection ovens by assuring delivery of the maximum heat possible to the oven chamber before exhaust through the flue. The following United States patents, U.S. Pat. No. 3,148,674 (Boardman), U.S. Pat. No. 3,259,120 (Keating), U.S. Pat. No. 3,710,775 (Tamada), U.S. Pat. No. 4,108,139 (Gilliom), U.S. Pat. No. 4,357,522 (Husslein), U.S. Pat. No. 4,516,012 (Smith), U.S. Pat. No. 4,498,453 (Ueda) and U.S. Pat. No. 4,036,562 (Barnes) disclose blowers positioned over an opening in the liner which compel the recirculation by forced convection of the heated air and increase the efficiency of heat transfer from the heat source to the oven chamber.

The construction of the prior art devices, which include blower wheels, do not provide for uniform air distribution within the oven chamber. Therefore bread and other foods baked in such ovens, depending on the food's location within the oven chamber, are not properly cooked, and/or are physically disturbed by the recirculating air.

On the contrary, the enhanced air-flow convection oven according to this invention, creates a novel air circulation route to propel air through the oven chamber, maximizing heat transfer, while providing uniform air distribution without disturbing bread and other foods being baked, irrespective of the food's location within the oven chamber.

SUMMARY OF THE INVENTION

Accordingly, it is a primary object of this invention to obtain improved recirculation and improved air flow within a convection oven and provide balanced heat within an oven chamber.

A further object of this invention is to provide an improved blower wheel assembly which is adapted to implement the recirculation of air particularly in a forced convection oven.

Additionally, it is an object of this invention to feed heated air directly from the combustion chamber and mix it with indirectly fed heated air from the combustion chamber in the blower wheel assembly and recirculate heat balanced air within the oven chamber prior to discharge through the exhaust flue.

To achieve these and other objects of this invention the enhanced air-flow convection oven is constructed by forming an oven having a thermally insulated outer shell, that circumscribes an oven chamber liner (inner shell). The fixed distance between the insulated outer shell and the oven chamber liner creates a combustion chamber and passageway for heated air. A heat source, preferably a gas burner, is positioned within the combustion chamber, preferably below the floor of the liner. An air inlet opening and an air outlet opening are constructed within the chamber liner. An exhaust flue, connected to the air outlet opening, extends over the upper wall of the liner, and acts as a vent. A blower wheel assembly, formed with a concave central plate with apertures lying in planes askew to a plane perpendicular to the axis of the blower wheel assembly, is positioned over the air inlet opening and draws air from both the combustion chamber and the oven chamber for recirculation.

A particularly unique feature of this invention is the improved blower wheel assembly having a concave central plate with apertures lying in planes askew to a plane perpendicular to the axis of the blower wheel assembly. The blower wheel assembly is particularly adapted to be utilized with a forced convection oven and may be used within either an electric or gas oven. Because the edges of the apertures are skewed with respect to a plane perpendicular to the axis of rotation, a negative pressure is formed behind the blower wheel assembly inducing a flow of hot air through the apertures in the central plate. In typical convection ovens, the two air streams, an intake ambient air stream and a heated air stream from air warmed over a heating device, are mixed in the heating compartment where the actual food is baking, (see typically U.S. Pat. No. 4,516,012 to Smith, claim 1, lines 57–58). The two air streams created by the device according to this invention are mixed in the blower wheel assembly, aided by the skewed aperture construction, before being centrifugally ejected.

Another feature of this invention is the use of a particular baffle plate in the oven, with edges spaced from the oven chamber liner so as to facilitate an air flow to and from the blower. This feature varies greatly from the prior art and produces better heating results.

A further feature of this invention is the use of a blower back plate in combination with a blower wheel assembly for the creation of a direct flow path for hot air from the combustion chamber of the oven to the baking chamber, in addition to the circuitous paths as in the prior art.

Another feature of this invention is the concavity of the central plate of the blower wheel assembly along with the axial blade construction of the blower wheel assembly. This design creates a negative pressure behind the blower wheel assembly which induces a flow of hot air through the apertures in the central plate.

A final feature of this invention is that all of the combustion occurs outside of the oven chamber and the products of combustion are channelled into the back of the blower wheel assembly. Again, this feature provides uniform heating as the blower wheel assembly mixes currents or streams of air of different temperatures and discharges the air into the oven chamber at a uniform temperature. By contrast, in the prior art devices of Ueda U.S. Pat. No. 4,498,453 and the like, the combustion occurs within the oven chamber.

DETAILED DESCRIPTION OF THE PREFERRED EMBODIMENTS

Figure 1:
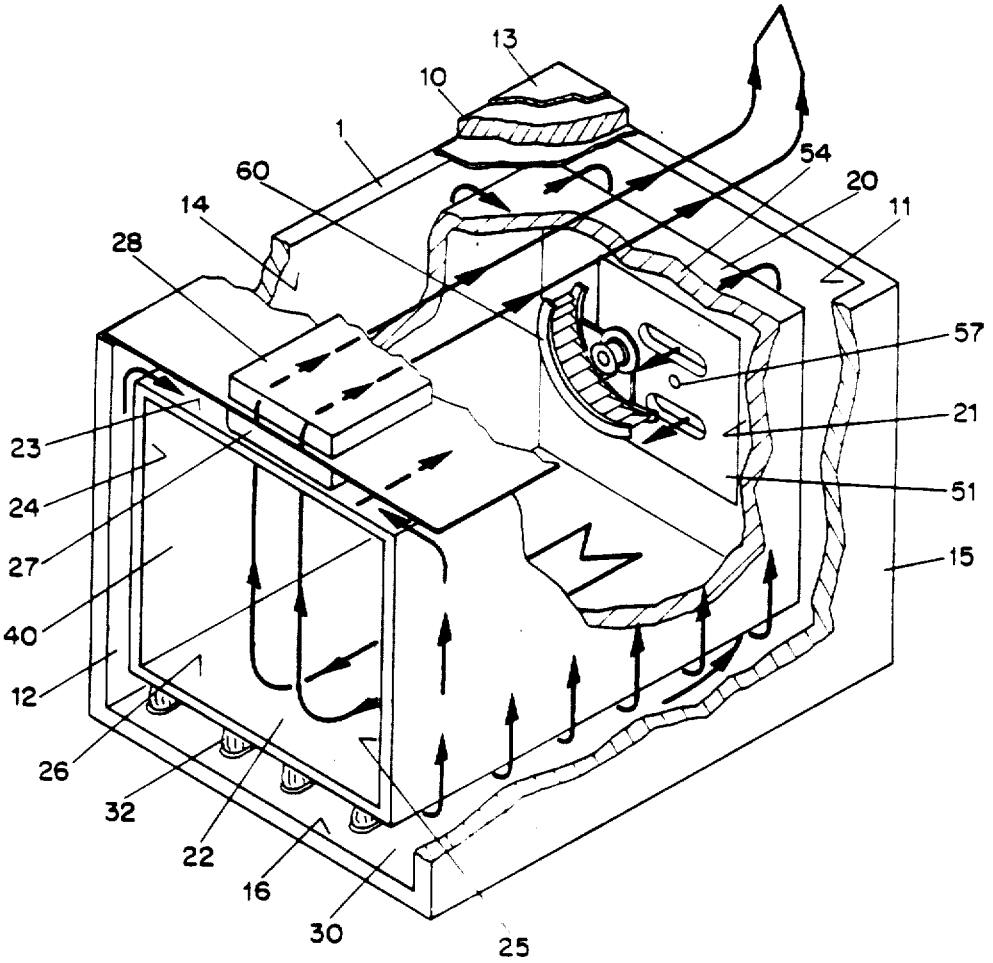
FIG. 1 is a perspective view of an enhanced air-flow convection oven with parts removed and some parts shown in section to disclose the internal construction thereof.

Referring now to the drawings, wherein like reference characters refer to like and corresponding parts throughout the several views, FIG. 1 illustrates an enhanced air-flow convection gas oven 1 comprising an outer shell 10, circumscribing an inner shell 20, creating a combustion chamber 30 therebetween. The combustion chamber 30 also serves as a passageway for heated air. Inner shell 20 houses generally, oven chamber 40, where the cooking occurs.

According to FIG. 1, an outer shell 10 is preferably formed of conventional thermal insulating materials, such as ceramics, fiberglass or the like, that are generally held between spaced sheets of steel, to provide the desired insulation. The outer shell 10 should measure approximately 35¾" deep, 34" wide and 33⅜" high inside. Outer shell 10 is formed with a closed rear wall 11, open front 12, upper wall 13, left and right walls 14 and 15, and floor 16. An insulated door (not shown) may be positioned over the open front 12. Arranged within outer shell 10 is inner shell or liner 20, formed of a heat conducting material, preferably sheet steel or the like. The inner shell or liner 20, like the outer shell 10, comprises a closed rear wall 21, open front 22, upper wall 23, left and right walls 24 and 25, and floor 26. The inner shell 20 is geometrically similar to the outer shell 10, as is best seen in FIG. 1, and the space between the walls of outer shell 10 and the walls of inner shell 20, provides for air flow paths, which are indicated by the darkened arrows in FIG. 1.

The preferred embodiment is described in terms of a standard full size oven. Accordingly, the dimensions necessary to construct this size oven and blower assembly are provided herein. However, these dimensions may be varied in order to construct ovens of different sizes.

For a full size oven, the inner shell 20, preferably 25" deep, 29" wide and 20" high inside, encloses and defines oven chamber 40. The inner shell is formed with an adjustable air outlet opening 27 of a minimum area corresponding to the dimensions 3/16"×5½" cut into the upper wall 23 of inner shell 20 and an air inlet opening 29 (see FIG. 2) cut into the rear wall 21 of inner shell 20.

An exhaust flue 28, formed preferably of sheet metal, is mounted at a distance from the outside upper wall 23 of inner shell 20 and extends in the space between upper 20. The exhaust flue 28 runs the length of upper wall 13 of outer shell 10 from the adjustable air outlet opening 27 of inner shell 20 to the closed rear wall 11 to a vent (not shown). The exhaust flue must have a cross section greater than or equal to the area of the air outlet opening during use.

A heat source 32 is arranged preferably in the space between floor 26 of inner shell 20 and floor 16 of outer shell 10, forming generally a combustion chamber 30 (or area of combustion) as best seen in FIG. 1.

Figure 2:
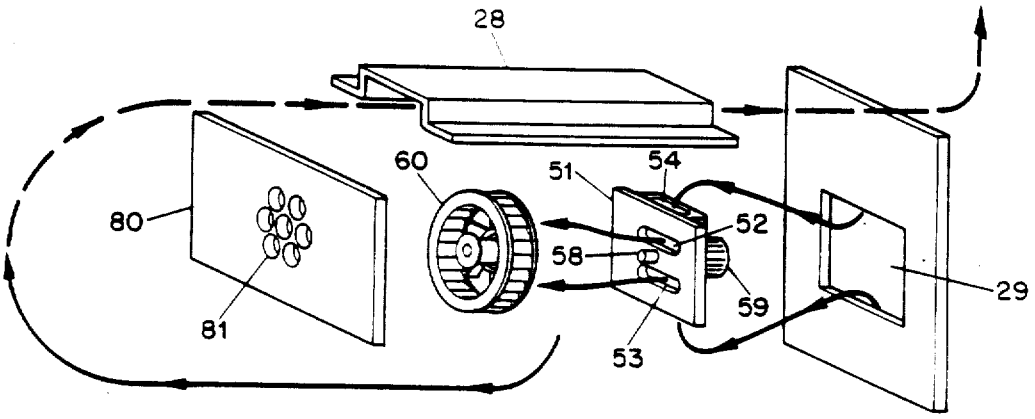
FIG. 2 is an exploded, perspective view of the blower wheel assembly and air constraining plates.
Figure 3:
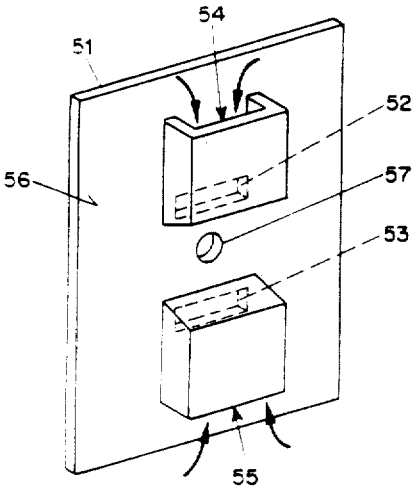
FIG. 3 is an isometric view of a blower back plate.

Arranged within oven chamber 40 and supported on rear wall 21 of inner shell 20 is blower wheel assembly 60 shown in the exploded view of FIG. 2. A blower back plate 51 is sizingly adapted to fit into air inlet opening 29 in the rear wall 21 of inner shell 20. Blower back plate 51, (shown in greater detail in FIG. 3) preferably has rectangular air passages 52 and 53 of the dimensions 6"×¾" for a full size oven. Slots 52 and 53 are covered respectively by upper and lower back plate flues 54 and 55 each having a minimum opening of 6"×¾". Flues 54 and 55 allow for the entry and flow of air in the directions indicated by the arrows in FIG. 3, therefore the air flows through slots 52 and 53 and into blower wheel assembly 60.

Consequently, as shown in FIG. 1, hot air flows from combustion chamber 30 to oven chamber 40 both directly and indirectly as illustrated by the blackened arrows of FIG. 1. Hot air flows directly from the heat source 32, along the exterior of the bottom 26, up the exterior of the back wall 21, into flue 55, through blower back plate lower slot 53 and into oven chamber 40. Hot air flows indirectly from the heat source 32, along the bottom 26, exterior of side walls 24 and 25, top 23, down the exterior of back wall 21, into flue 54, through blower back plate upper slot 52 and into oven chamber 40. A small portion of the heated balanced air in proportion to the hot air inlet is forced through adjustable air outlet opening 27, through exhaust flue 28, to the vent.

A motor shaft opening 57 in blower back plate 51 accomodates a shaft 58 (FIG. 2) of blower motor 59. Blower wheel assembly 60 is affixed to shaft 58 such that the motor 59 will lie in the space behind the closed rear wall 11 of outer shell 10.

Figure 4:
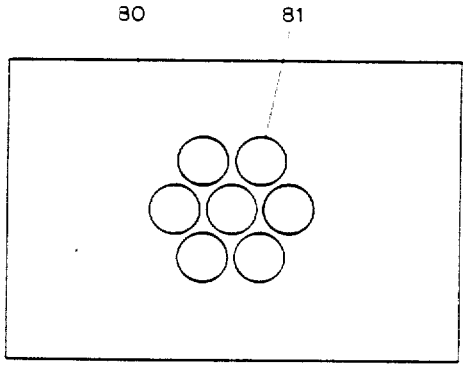
FIG. 4 is a front view of a baffle plate.

A baffle plate 80 (FIG. 2), is positioned over the front (facing the oven chamber) of blower wheel assembly 60 and provides for an air flow path between the edges of baffle plate 80 and the interior surfaces of the walls, top, and floor 23–26 of inner shell 20. The baffle plate 80 is provided with one or more openings 81 which are dimensioned to provide a free flow of air to the interior of blower wheel assembly 60. For a full size oven the multiple openings 81 are preferably seven round holes each of a 3" diameter, as configured in FIG. 4. The multiple openings 81 however, may be square, rectangular or of any configuration. The baffle plate 80 may contain ridges in order to stiffen the plate, and holes along the edge for mounting the plate to the sides of the inside of the inner liner 20.

Figure 5:
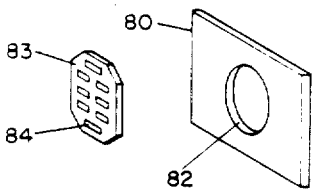
FIG. 5 is an isometric view of a second embodiment of the baffle plate.

In a second embodiment, as illustrated in FIG. 5, baffle plate 80 is provided with one large opening 82, preferably circular, which is dimensioned to provide a free flow of air to the interior of blower wheel assembly 60. A diffuser plate 83 is formed preferably with spaced, horizontally extending slots 84 and is dimensioned to lie over opening 82 and be secured to baffle plate 80.

Figure 6:
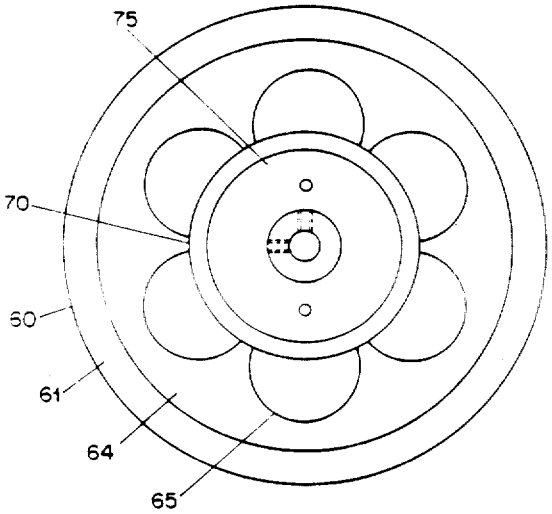
FIG. 6 is a front view of the preferred embodiment of a blower wheel assembly.
Figure 7:
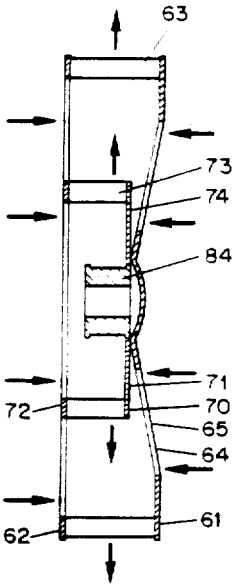
FIG. 7 is a side view in section of the first embodiment of a blower wheel assembly.

Blower wheel assembly 60, as illustrated in FIGS. 6 and 7, is circular and measures 1 21/32" from a plate rim 61 and a blade rim 62 which are separated by a plurality of spaced blower blades 63 preferably 1½" long that are secured between rims 61 and 62. Typically, each rim is 9⅞" in diameter and there are 42 blower blades 63. A concave central plate 64, with its concavity facing the blade rim 62, has a hub 84 for motor shaft 58 and is secured to the plate rim 61. Plate rim 61 may be formed integrally with concave central plate 64 or as separate units to be later bonded together. Concave central plate 64 contains a plurality of apertures 65 which may be shaped in any manner. Preferably there should be six apertures, each 2¼" in diameter, and each located on a pitch circle of 2 13/16" radius from the center of central plate 64. These apertures 65 are elliptical when viewed in planned projection with a major axis extending radially from the center of blower wheel assembly 60. Except for the ends of the major axis of the ellipse (or any other line extending through differently shaded openings extending radially from the center of blower wheel assembly 60), the points along the periphery of apertures 65 are along different planes because the plate they are located on is concave. Reinforcing ribs 66, formed on concave central plate 64, increase the plate's strength.

Also secured to the plate rim 61 is an inner wheel 70 which fits around the hub 84. Inner wheel 70 is similar in structure to the blower wheel assembly 60; however, it is smaller in diameter and thickness and preferably has no concavity or apertures therein. In this embodiment, inner wheel 70, within blower wheel assembly 60, actually represents a small blower wheel assembly (inner wheel 70) within a large blower wheel assembly. Inner wheel 70 has an approximate 5¼" diameter and 1 5/32" thickness between inner plate rim 71 and inner blade rim 72 which are separated by a plurality of inner spaced blower blades 73, preferably 1" long, that are secured between rims 71 and 72. Typically, there are 26 blower blades. An inner central plate 74 is secured to the inner plate rim 71. The inner plate rim 71 may be formed integrally with inner central plate 74 or as separate units to be later bonded together. Also, inner central plate 74 may contain a plurality of inner apertures 75 shaped to coincide with the plurality of apertures 65 of concave central plate 64.

The blower wheel assembly is mounted between the back plate 51 and the baffle plate 80. Plate rim 61 of the blower assembly is mounted on the motor shaft 58 at a distance of ½" from the blower back plate 51 which is mounted flush with the oven liner back wall 21. Baffle plate 80 is mounted ¾" in front of blade rim 62 of the blower wheel assembly by brackets or any other suitable means.

In operation, the improved blower wheel assembly 60, with its concave central plate 64 having apertures 65 lying in planes askew to a plane perpendicular to the axis of the blower wheel assembly 60, generates a negative pressure behind the blower wheel assembly 60 and induces hot air through the apertures 65 in the concave central plate 64. Blower wheel assembly 60 which comprises inner wheel 70 in this embodiment forms two cylindrical and parallel streams of recirculating air moving in the same direction towards blower wheel assembly 60. One of the streams is a solid cylinder with a diameter in relation to the inner wheel's diameter. The other stream is a hollow cylinder with a diameter in relation to the diameter of the blower wheel assembly 60. This stream draws air from the oven chamber, which is supplemented by the air radially discharged by inner wheel 70. This air mixes within the blower wheel assembly 60 with the hot air induced through the apertures 65 from behind the blower wheel assembly 60 and is radially discharged by utilizing blades 63 of blower wheel assembly 60. The air flow is indicated by the arrows in FIG. 7. The difference between the air radially discharged by the blower wheel assembly 60 and the air radially discharged by the inner wheel 70 is the amount of air moving in the hollow cylinder generated by blower wheel assembly 60. Air in the hollow cylinder moves at a much lower velocity (because of the presence of a higher pressure discharge from inner wheel 70) as compared to other embodiments of blower wheel assembly 60 which do not employ inner wheel 70. By employing a smaller wheel 70 with different diameters and blade lengths 73 in relation to the differing diameters and blade lengths 63 of blower wheel assembly 60 of this embodiment, the air movement in the hollow cylinder can be matched with the air movement in the solid cylinder generated by the inner wheel 70. This balancing results in a very homogeneous environment in the oven chamber. All air moves at the same velocity and therefore transfers heat energy evenly throughout the oven chamber.

Figure 8:
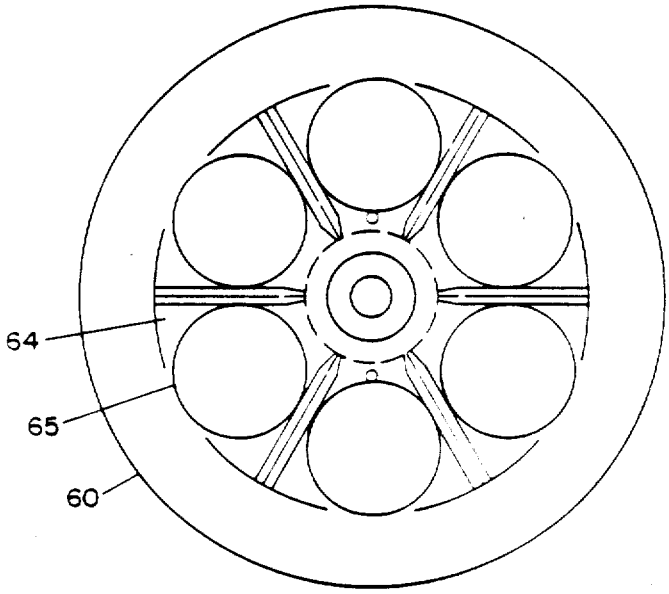
FIG. 8 is a front view of a second embodiment of a blower wheel assembly.
Figure 9:
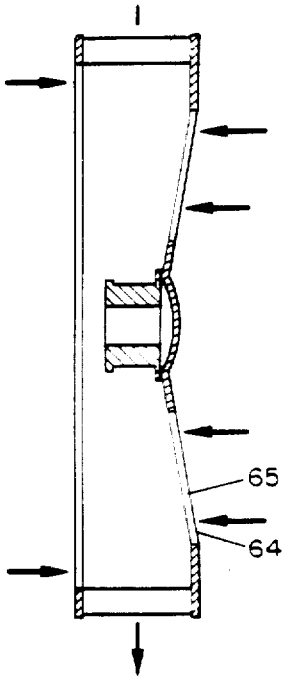
FIG. 9 is a side view in section of the second embodiment of a blower wheel assembly.

FIGS. 8 and 9 illustrate a second embodiment of the blower wheel assembly 60. This configuration is exactly the same as the first embodiment except that no inner wheel 70 exists. The apertures 65 of the concave central plate 64 still generate a negative pressure which induces hot air through the apertures 65 from behind. This air mixes within the blower wheel assembly 60 with the air in from the front of the blower wheel assembly 60. The mixture is radially discharged by utilizing blades 63 of blower wheel assembly 60.

Although the mixture that occurs in this embodiment is not as homogeneous as the mixture that occurs when utilizing inner wheel 70, for certain applications this embodiment may be superior. This embodiment features a simpler design and is more economical to manufacture.

Figure 10:
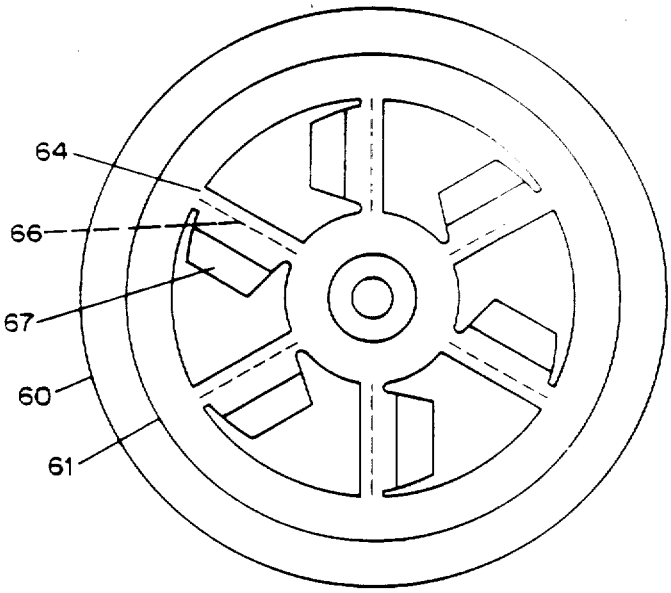
FIG. 10 is a front view of a third embodiment of a blower wheel assembly.
Figure 11:
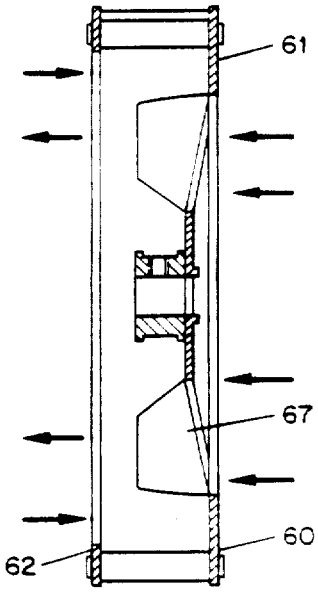
FIG. 11 is a side view in section of the third embodiment of a blower wheel assembly.
Figure 12:
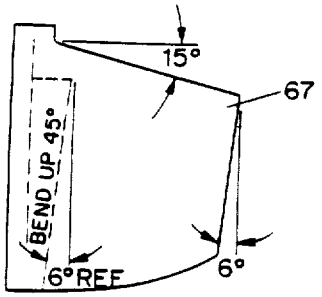
FIG. 12 is a front view of a projecting fan blade.

In a third embodiment, illustrated in FIGS. 10 and 11, blower wheel assembly 60, in addition to plate rim 61, blade rim 62, concave central plate 64 and a plurality of blades 63 between plate rim 61 and blade rim 62, comprises radial projecting fan blades 67 (FIG. 12), secured to concave central plate 64. Fan blades 67 are attached to the forward edge of reinforcing ribs 66 and project in a direction from concave central plate 64 towards blade rim 62 forming approximately a 45° angle therebetween.

This projecting fan blade construction provides a similar scooping effect of air from behind blower wheel assembly 60, and causes the air to move axially towards blower wheel assembly 60 as indicated by the small arrows in FIG. 11. On entering blower wheel assembly 60, some of the air continues to move axially out to the area beyond baffle plate 80 in the form of a cylinder of a diameter in relation to the radial position of projecting fan blades 67. This cylinder is enveloped by another outer larger cylinder (shown by the large arrows in FIG. 11) in which a stream of air moves in a path opposite and parallel to the first cylinder's path. In the front of blower wheel assembly 60 the two streams of air, moving in opposite directions, mix at a point of balanced force or velocity and the mixture gets drawn to blower wheel assembly 60 in the form of the outer hollow cylinder. This mixture is then expelled by blades 63 of blower wheel assembly 60.

Figure 15:
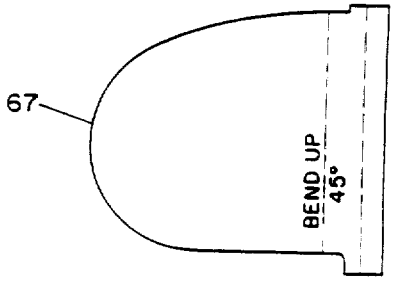
FIG. 15 is a front view of a projecting fan blade.
Figure 13:
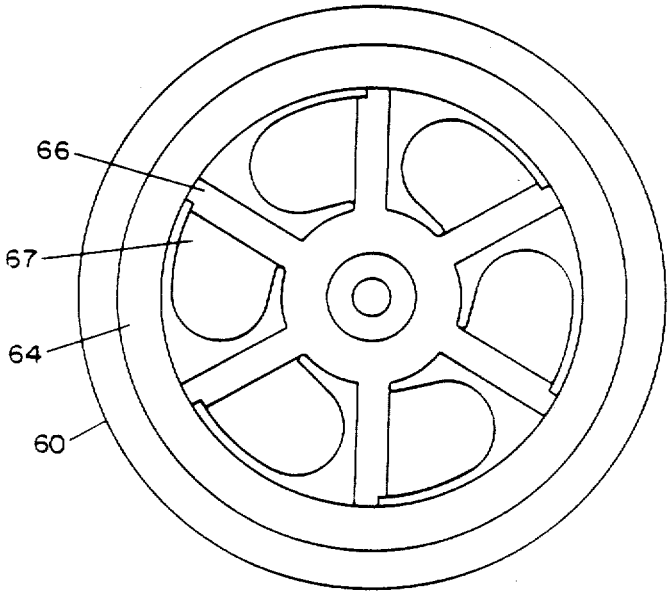
FIG. 13 is a front view of a fourth embodiment of a blower wheel assembly.
Figure 14:
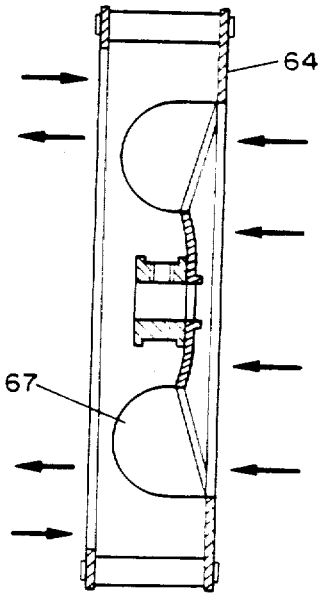
FIG. 14 is a side view in section of the fourth embodiment of a blower wheel assembly.

A fourth embodiment, which is illustrated in FIGS. 13 and 14, is very similar to the third embodiment except for the shape and attachment of projecting fan blades 67 (FIG. 15). In this fourth embodiment, projecting fan blades 67 are curved at the edge furthest from the attachment of fan blades 67 to concave central plate 64. Also, the attachment is off the back edge of the reinforcing ribs 66 forming approximately a 45° angle between the fan blade 67 and the plane of the reinforcing rib 66. This projecting fan blade construction provides the same scooping effect of air from behind blower wheel assembly 60. The flow of air is indicated by the arrows of FIG. 13. The mixture of the air, in the front of blower wheel assembly 60, is the same as that described in the third embodiment.

In yet another embodiment of the present invention, the forced convection oven may be electrically heated. In such a configuration, there is no need to provide a blower back plate 51. A heating element can be placed between the inner shell back wall 21 and the blower wheel assembly 60. The blower wheel assembly 60 functions only to recirculate the air within the oven chamber, and provides a similar air flow resulting in a balanced heat. Blower wheel assembly 60 when used in such a manner within an electrical convection oven provides comparable results as compared to the gas oven.

While the invention has been illustrated and described as embodied in an enhanced air-flow convection oven, it is not intended to be limited to the details shown, since various modifications and structural changes may be made without departing in any way from the spirit of the present invention.

What is claimed as new and desired to be protected by letters patent is set forth in the appended claims.

1. A blower wheel assembly comprising a hub;

a central plate surrounding the hub having a concave outer side and a convex inner side;

a plate rim secured to said central plate;

a plurality of spaced blower blades protruding from the inner side of said plate rim for expelling air from the inner side of said central plate outward from said blower blades; and aperture means for enabling the passage of air from the outer side of said central plate to the inner side of said plate to permit air from the outer side to also be expelled outward from said blower blades;

whereby a single set of blower blades acts to expel air from both sides of the central plate outwardly from the blower wheel assembly.

2. A blower wheel assembly as in claim 1 wherein said aperture means comprises a plurality of openings and fan blade means associated with said openings for drawing air through said openings.

3. A blower wheel assembly as in claim 1, wherein said hub is configured for coupling to the rotating shaft of an electric motor, whereby during rotation air is drawn from both the concave and convex sides of the central plate, mixed and expelled outwardly from the blower blades.

4. A blower wheel assembly as in claim 1, wherein said hub is configured for coupling to the rotating shaft of an electric motor mounted within an oven, whereby the flow of heated air throughout the oven is enhanced by drawing air from both the concave and convex sides of the central plate, mixing such air and expelling it from the blower blades.

5. A blower wheel assembly as in claim 1 wherein said aperture means comprise has a plurality of openings lying in planes askew to a plane perpendicular to an axis of the blower wheel assembly.

6. A blower wheel assembly as in claim 1 wherein the central plate has reinforcing ribs having a back edge and a forward edge.

7. A blower wheel assembly as in claim 1 wherein said blower wheel assembly further comprises an inner wheel, smaller in diameter and thickness than said blower wheel assembly, secured to said plate rim and fitted around said hub.

8. A blower wheel assembly as in claim 7 wherein said inner wheel comprises an inner plate rim;

an inner blade rim;

a plurality of inner spaced blower blades attached between said inner plate rim and said inner blade rim; and an inner central plate secured to the inner plate rim.

9. A blower wheel assembly as in claim 8 wherein said inner central plate contains a plurality of apertures.

10. A blower wheel assembly as in claim 9 wherein said plurality of apertures are shaped to coincide with a plurality of apertures of said blower wheel assembly.

11. A blower wheel assembly as in claim 6 wherein said blower wheel assembly further comprises radial projecting fan blades attached to said forward edge of said reinforcing ribs of the central plate.

12. A blower wheel assembly as in claim 6 said blower wheel assembly further comprising curved projecting fan blades, curved at an edge furthest from attachment of the blades to said back edge of said reinforcing ribs of the central plate.

* * * * *

UNITED STATES PATENT AND TRADEMARK OFFICE

CERTIFICATE OF CORRECTION

PATENT NO. : 4,981,416

DATED : Jan. 1, 1991

INVENTOR(S) : Nevin et al.

It is certified that error appears in the above-identified patent and that said Letters Patent is hereby corrected as shown below:

ON TITLE PAGE: 2nd col., following the third line, insert:

-- FOREIGN PATENT DOCUMENTS 465,668 9/1951 Italy ..... 415/203--;

ON TITLE PAGE: 2nd col., 7th line of ABSTRACT, "blower" should read --blower wheel--. Col. 4, line 17, after "upper" insert --wall 13 of outer shell 10 and upper wall 23 of inner shell--. Col. 5, line 36, "shaded" should read --shaped--. Col. 8, line 11, "comprises" should read --comprise--; line 28, "comprise has" should read --comprise--.

Signed and Sealed this

Seventh Day of July, 1992

*Attest:*

*Attesting Officer*

DOUGLAS B. COMER

*Acting Commissioner of Patents and Trademarks*

Disclaimer 4,981,416—Ira Nevin, Eastchester; Narendra Nath, Copiague, both of N.Y. ENHANCED AIR-FLOW BLOWER WHEEL. Patent dated Jan. 1, 1991. Disclaimer filed March 6, 1997, by the assignee, Bakers Pride Oven Co., Inc.

Hereby enters this disclaimer to claims 1, 3, 4 and 5 of said patent.

*(Official Gazette,* August 12, 1997)